US007793587B2

(12) United States Patent
Coursey et al.

(10) Patent No.: US 7,793,587 B2
(45) Date of Patent: Sep. 14, 2010

(54) LASER ALIGNMENT DEVICE COMPRISING PLUNGER

(75) Inventors: David J. Coursey, Conyers, GA (US); Brightman Kenneth Holliday, Conyers, GA (US)

(73) Assignee: Atlas Die LLC, Elkhart, IN (US)

( * ) Notice: Subject to any disclaimer, the term of this patent is extended or adjusted under 35 U.S.C. 154(b) by 249 days.

(21) Appl. No.: 12/157,109

(22) Filed: Jun. 6, 2008

(65) Prior Publication Data

US 2009/0301321 A1 Dec. 10, 2009

(51) Int. Cl.
*B30B 15/04* (2006.01)

(52) U.S. Cl. ..... 100/269.12; 100/35; 100/99; 83/522.15

(58) Field of Classification Search ..... 100/35, 100/99, 102, 269.12; 83/520, 522.15
See application file for complete search history.

(56) References Cited

U.S. PATENT DOCUMENTS 2,693,752 A * 11/1954 Garapolo ..... 100/51
2,806,492 A * 9/1957 Becker ..... 83/520
5,299,515 A * 4/1994 Baba et al. ..... 112/141
6,769,354 B2 * 8/2004 Chen ..... 100/35

* cited by examiner

*Primary Examiner*—Jimmy T Nguyen
(74) *Attorney, Agent, or Firm*—Kilyk & Bowersox, P.L.L.C.

(57) ABSTRACT

According to various embodiments, the present teachings relate to an alignment device, method, and system for aligning an upper platen of a paperboard press with a lower platen of a paperboard press. The alignment device can comprise a latching collar adapted to be mounted on a lower platen. The latching collar can comprise a central hole and can be adapted to be mounted on or affixed to the lower platen. The latching collar can comprise a locking area. The alignment device can further comprise a plunger unit. The plunger unit can comprise a housing, a securing device attached to the housing, and a plunger configured for reciprocal motion through the housing. The securing device can be adapted to removably secure the housing to a top surface of an upper platen of a paperboard press. The alignment device can further comprise a biasing device for normally biasing the plunger in a retracted position with respect to the housing yet permitting the plunger to be pushed partially through the housing to attain an extended position.

19 Claims, 10 Drawing Sheets

LASER ALIGNMENT DEVICE COMPRISING PLUNGER

FIELD

The present teachings relate to the field of paper or other fiber product manufacturing, and more particularly to a device and method for aligning an upper platen of a paperboard press with a lower platen of a paperboard press.

BACKGROUND

Packaging, stationary, and other paper-based products are generally manufactured using sheets of raw paper stock or other materials that are drawn across presses, dies, punches, or other paper-cutting or paper-forming equipment. Beverage and other cartons, containers, playing cards, signs, placards, corrugated boxes, and other paper or fiber-based or other products, are generally formed by contacting a sheet or web of raw material with a punch or die when stripping-out desired areas of material. Such products can also be formed by contacting the sheet or web with a cutting or fold-making blade when generating blanks out of the sheet.

In stripping, blanking, embossing, die-cutting, and other paperboard operations, the raw feedstock can be in the form of paper, cardboard, plastic, fibrous, or other material, which is conveyed over a working area. The working area can generally include a flat cutting surface or hollow female blanking area affixed to a lower platen of a paperboard press, over which a blank stock can be drawn, placed, or positioned on, and can be contacted with a blade, punch, or other working tool affixed to an upper platen of a paperboard press. The sheets are conveyed through work areas on support frames, for example, wooden, metal, or other support frames, which can be sized to conform to the input sheets. The sheets can be conveyed across the stripping or blanking areas using belt drives, linear motors, or other sources of mechanical driving force.

In order to perform paperboard operations, the upper platen, or male platen, along with the cutting, blanking, or stripping tool affixed to the upper platen, must be aligned with the cutting surface or support frame affixed to the lower platen, or female platen. Under current practice, this alignment is done by guess and check. A worker or other user of the paperboard press, positions themselves above or below the two platens and eyeballs the boards until the worker decides the boards are properly aligned. Such a feature is time consuming, and often times can lead to human error. A need exists to eliminate these and other drawbacks in the art.

SUMMARY

According to various embodiments, the present teachings relate to an alignment device for aligning an upper platen of a paperboard press with a lower platen of a paperboard press. The alignment device can comprise a latching collar adapted to be mounted on a lower platen. The latching collar can comprise a central hole and can be adapted to be mounted on or affixed to the lower platen. The central hole can have a first diameter. The latching collar can comprise a locking area. The locking area can comprise an indention, groove, shoulder, or other design.

In some embodiments, the alignment device can comprise a plunger unit. The plunger unit can comprise a housing, a securing device attached to the housing, and a plunger configured for reciprocal motion through the housing. The securing device can be adapted to removably secure the housing to a top surface of an upper platen of a paperboard press. The plunger can comprise a handle end, a distal end opposite the handle end, and a shaft that extends from the handle to the distal end. The distal end of the plunger can have a diameter equal to or less than the diameter of the central hole of the latching collar. The alignment device can further comprise a biasing device for normally biasing the plunger in a retracted position with respect to the housing yet permitting the plunger to be pushed partially through the housing to attain an extended position.

According to various embodiments, the alignment tool can be used with various paperboard press operations, for example, a blanking press, a stripping press, a die-cutting press, an embossing press, other paperboard press operations, or a combination thereof. The alignment device can comprise a laser source in the housing and a power supply in the housing connected to the laser source. The laser source can be adapted to emit at least one excitation beam or laser beam through a hole in the upper platen and onto a top surface of the lower platen. The securing device can be further adapted to trigger the power supply connected to the laser source. In various embodiments, the distal end of the plunger can comprise a locking device configured to lock the plunger into the latching collar.

According to various embodiments, the present teachings relate to a system comprising the alignment device, an upper platen of a paperboard press, and a lower platen of a paperboard press, wherein the plunger unit of the alignment device can be secured to a top surface of the upper platen, and the latching collar of the alignment device can be fixed to the lower platen. The lower platen and the upper platen of the system can be aligned such that when the plunger is in the extended position and extends through the upper platen, the distal end of the plunger can be received in the latching collar. In various embodiments, the lower platen of the system can further comprise one or more alignment indicia, for example, a mark or other indicator in the top surface of the platen. The plunger unit can further comprise a laser source configured to provide a laser beam directed out of a bottom of the housing. The laser source can be stored in the housing. The upper platen can comprise a hole aligned with the laser beam and can be disposed to allow the laser beam to pass through the upper platen. The system can be configured to align the plunger and the latching collar using the laser beam and the one or more alignment indicia.

According to various embodiments, the present teachings relate to a method for aligning an upper platen of a paperboard press with a lower platen of a paperboard press. The method comprises fixing a latching collar to the lower platen, and the latching collar can comprise a central hole having a diameter. The method can also comprise securing a plunger unit to the upper platen, the plunger unit comprising a housing, a securing device to removably secure the plunger unit to the upper platen, and a plunger configured for reciprocal motion through the housing and being adapted to extend through the upper platen. The plunger can comprise a distal end having a diameter that is less than or equal to the diameter of the central hole of the latching collar. The method further can further comprise moving the plunger through the first platen so that the distal end of the plunger is inserted into the central hole of the latching collar.

According to various embodiments, the method can comprise providing alignment indicia on the top surface of the lower platen, and a hole in the upper platen. The housing can further comprises a laser source adapted to emit a laser beam through the hole in the upper platen, and the method further comprises aligning the plunger and the latching collar using the laser source and the alignment indicia. Further, the plunger unit can be secured to the upper platen and can further be configured to trigger power to the laser source.

DETAILED DESCRIPTION

Figure 1A:
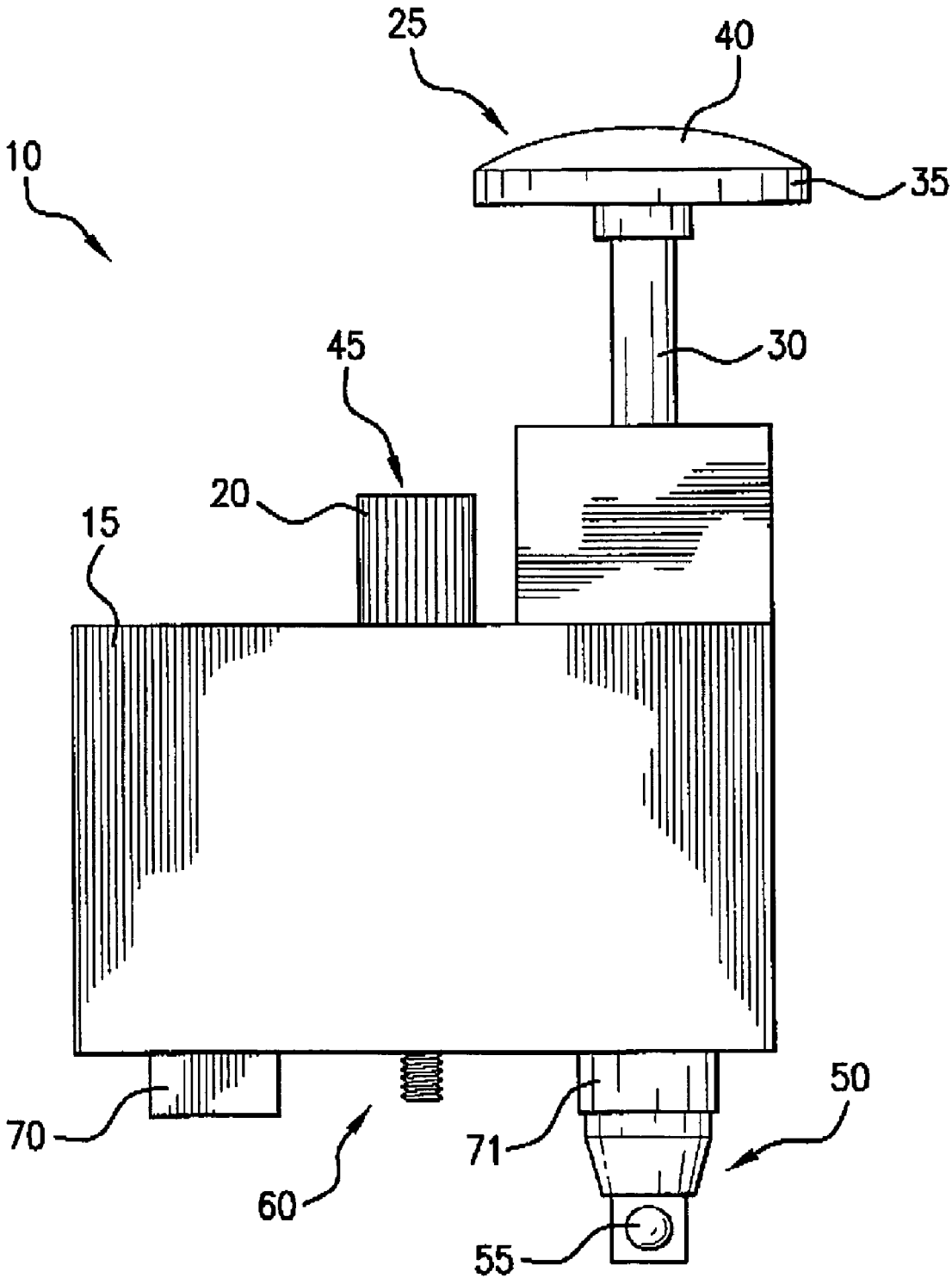
FIG. 1A is perspective view of a plunger unit comprising a housing, a securing device, and a plunger, according to various embodiments of the present teachings.

According to various embodiments, the present teachings relate to an alignment device for aligning an upper platen of a paperboard press with a lower platen of a paperboard press. As referred to herein, "a paperboard press" can be configured for any type of paperboard operation, for example, blanking, stripping, embossing, die-cutting, another type of paperboard operation, or any combination thereof. The alignment device can comprise a latching collar for a female platen. The latching collar can comprise a central hole having a diameter. The diameter of the latching collar can be from a range of 1 mm to 100 mm, for example, in a range between 5 mm and 70 mm, in a range between 10 mm and 50 mm, and in a range between 20 mm to 35 mm. The hole can have a diameter in the same ranges, but smaller than the diameter of the entire collar. The latching collar can comprise any type of metallic material, for example, brass, aluminum, steel, copper, another type of metal, an alloy or any combination thereof.

According to various embodiments, the alignment device can comprise a plunger unit. The plunger unit can comprise a housing comprising any type of metallic material, for example, aluminum, steel, copper, brass, another type of metal, or any combination thereof. The housing can comprise a top surface, a bottom surface, and a body that extends from the top surface to the bottom surface. The housing can be shaped into any size or mold, for example, the housing can have a relatively flat bottom surface. The housing can have a bottom surface adapted to be secured into holes in a board, for example, the bottom surface of the housing can comprise one or more knobs designed to rest in a hole disposed in a top surface of a platen. The top of the housing can be relatively flat or it can be multi-tiered, for example, the housing can comprise a raised portion where the plunger can be disposed and a lower portion where the securing device and the laser source are to be disposed.

According to some embodiments, the body of the housing can have rounded edges, cornered edges, or a combination thereof. The body of the housing can take any form, and can be of any shape or size desired. For example, the body of the housing can be rectangular in shape, square, triangular, elliptical, circular, semi-circular, other desired shape, or a combination thereof. It will be appreciated that the design of the body of the housing is not limited to any specific shape, size, or material.

According to various embodiments, the plunger unit can comprise a securing device that is adapted to removably secure the housing to a surface of the upper platen. The securing device can comprise, for example, a screw, a bolt, another threaded feature, or another fastener. The plunger unit can comprise a laser source in the housing, for example, attached to the housing, inside the housing, below the housing, or located somewhere in or on the housing.

According to various embodiments, the laser source can be adapted to emit a laser beam or laser beams through the bottom of the housing. In some embodiments, the laser source is housed in a laser module. The laser module can comprise a holding area for the laser source, the power supply, and/or the switch. The housing can be configured to receive the laser module. The housing can be configured to receive the laser source. The securing device can be configured such that it can trigger the power to the laser source upon being secured to a platen. For example, a switch, a limit switch, or other trigger can be located in the housing and in communication with the securing device, such that when the securing device comes into contact, or otherwise makes communication with the switch, the switch can trigger the power to the laser source. In some embodiments, the securing device can trigger the removal of power to the laser source. Such a feature can preserve battery supply or other power supply to the laser source.

According to various embodiments, the plunger unit can comprise a plunger. The plunger can be a rod, stem, shoot, staff, or other type of shafted instrument, having any type of shape or design, for example, the rod can be cylindrical, square, triangular, or any other size, shape, or design. The plunger can comprise an upper end and a distal end. A shaft can extend from the upper end of the plunger to the distal end of the plunger. A handle can be secured, fastened, embedded, or otherwise built into or onto the upper end of the plunger. The handle can be any shape size, or height. The handle can be configured such that a hand may operate the plunger by pushing on the plunger. In some embodiments, the distal end of the plunger can comprise a locking device, for example, hole cut in the side of the distal end of the plunger, and a spring loaded, captured, movable ball bearing resting in the hole. The hole can have an opening that is smaller than the diameter of the ball bearing, thereby preventing the ball bearing from escaping from the hole. The ball bearing can be adapted to move in reciprocal motion when pressure is applied to the ball bearing. For example, when pressure is applied to the spring loaded ball bearing, the spring can retract and can cause the ball to retract. When pressure is removed from the spring loaded ball bearing, the spring can force the ball back to its normal resting position.

In various embodiments, the central hole of the latching collar can be configured to receive the distal end of the plunger. The latching collar can be further configured to receive and secure the locking device of the plunger. The latching collar can comprise a groove or other indention, and the latching collar can be adapted such that when the distal end of the plunger is inserted into the latching collar, the spring loaded ball bearing can retract. When the distal end is inserted far enough into the latching collar, the spring loaded ball bearing can extend into the groove or insert of the latching collar. In this configuration, the latching collar can be configured to secure the distal end of the plunger without releasing the plunger.

In various embodiments, the latching collar can be configured such that when the distal end of the plunger is inserted into the latching collar, the spring loaded ball bearing can contact the edge of the latching collar. The latching collar can be of such a size that the distal end of the plunger is restricted from moving. The amount of difference between the diameter of the central hole of the latching collar and the diameter of the distal end of the plunger can be of many ranges, for example, from 0 microns to 500 microns, from 10 microns to 300 microns, from 20 microns to 200 microns, from 30 microns to 150 microns, or from 50 microns to 100 microns. As will be appreciated, these ranges are not meant to limit the amount of difference between the diameter of the central hole of the latching collar, and the diameter of the distal end of the plunger, and are only meant as examples. By keeping the difference in diameter between the two at such distances, the amount of give or play between the central hole and the distal end of the plunger can be restricted. By restricting the amount of play between the central hole and the plunger, the plunger can be kept secured in the latching collar during an aligning operation.

According to various embodiments, the contact of the distal end of the plunger comprising a locking device, for example, a spring loaded ball bearing, can cause the spring loaded ball bearing to retract. The latching collar can be configured with a ridge, groove, or other indention that is located somewhere within the latching collar. The latching collar can be configured to receive the ball bearing, and allow the ball bearing to extend back to its normal position. The latching collar can be adapted such that when the ball bearing is at its normal resting position, the ridge or groove can lock the ball bearing into place, thus, securing the plunger to the latching collar.

In various embodiments, the alignment device can comprise a biasing device that can normally bias the plunger in a relaxed position with respect to the housing yet permit the plunger to be pushed partially through the housing to attain an extended position. The biasing device can comprise, for example, a spring, or a plunger spring, in contact with the plunger.

According to various embodiments, the plunger can further comprise a pin retainer cap. The pin retainer cap can be integrally formed as a piece of the handle, it can be welded to the handled, it can be soldered to the handle, it can be screwed to the handle, or it can be connected, affixed, or otherwise incorporated to the handle in other ways. The cap can have a diameter that is wider than the diameter of the shaft of the plunger. The pin retainer cap can be located towards the handle end of the plunger. The spring can have a relaxed state that corresponds to a normally biased state of the plunger. When the plunger is pushed into an extended state, the pin retainer cap can contact the spring, and force the spring to a retracted state. In this retracted state, the spring can exert an upward force on the plunger by exerting an upward force on the pin retainer cap. When the distal end of the plunger is locked into the latching collar, the force of the spring, can be less than the locking force of the latching collar. When the distal end of the plunger is adjusted, or moved upward and out of the locked position in the latching collar, the spring can force the plunger back to its normally biased state, thus causing the spring to return to a relaxed state.

In various embodiments of the present teachings, the alignment device can be featured in a system that further comprises a lower platen of a paperboard press and an upper platen of a paperboard press. The upper platen can comprise a securing mechanism or a receiving area for receiving the securing device, for example, a threaded hole. The securing device can be configured to secure the housing to the upper platen by securing a threaded feature to the threaded hole. The upper platen can comprise a first hole, configured such that when the housing of the alignment device is secured to the upper platen, the plunger can extend through the first hole and protrude out the bottom of the upper platen. The first hole can be of various shapes and sizes, and can be configured to conform to the size and shape of the shaft. The diameter of the first hole can be of various ranges of lengths, for example, from 0.1 cm to 10 cm, from 0.3 cm to 5 cm, from 0.5 cm to 3 cm, or from 1 cm to 2 cm. As will be appreciated, these ranges are not meant to limit the width of the hole, and are only meant as examples. The upper platen can comprise a second hole. The second hole can be configured such that when the housing of the alignment device is secured to the housing, the laser source in the housing can emit a laser beam that is configured to pass through the bottom of the housing, and through the second hole of the platen, and out the bottom of the upper platen. The width of the second hole can be similar or equal to the width of the first hole of the upper platen.

According to various embodiments, the lower platen can comprise an area configured to receive the latching collar, such that the latching collar is affixed to the lower platen. The latching collar can be affixed into the lower platen, on the upper surface of the upper platen, or in various other locations of the lower platen. In some embodiments, the latching collar can be affixed to a top surface of the lower platen, such that the top of the latching collar is flush or relatively flush with the top surface of the lower platen. The plunger of the plunger unit can be configured to have a normally biased state and an extended state. In the normally biased state, the plunger can remain biased in the housing. In such a configuration the distal end of the plunger can protrude from the bottom of the housing, or it can be located within the housing and not protrude from the housing. In the normally biased state the plunger can extend through the upper platen and protrude out of the upper platen, or it can be biased within the upper platen. In the extended state, the plunger unit can extend through the housing and into and through the upper platen. Fully retracted, the plunger can further extend past the upper platen an additional distance, for example, a distance in a range of from 0 inches to 24 inches, from 1 inch to 12 inches, from 2 inches to 10 inches, from 3 inches to 6 inches. As will be appreciated, these ranges are not meant to limit the amount of distance the plunger can extend from the bottom of the upper platen, and are only meant as examples.

In various embodiments, the lower platen and the upper platen can be aligned such that when the plunger is in the extended position, and extends through the upper platen, the distal end of the plunger can be received by the latching collar. In some embodiments, the lower platen can further comprise alignment indicia. The alignment indicia can comprise any symbol, lettering, cross-hairs, numbering, hole, groove, or other indicator that can be incorporated into, drawn onto, embedded in, or otherwise affixed to or formed in the lower platen. The system can be configured to confirm alignment of the plunger and the latching collar using the laser source and the alignment indicia.

Various embodiments of the present teachings feature a method for aligning an upper platen of a paperboard press with a lower platen of a paperboard press. The method can comprise securing the latching collar to the lower platen. The latching collar can comprise a central hole having a first diameter. The method can comprise removably securing the plunger unit to the upper platen of the paperboard press. The plunger of the plunger unit can be configured for reciprocal motion through the housing and can be adapted to extend through the upper platen. The plunger can comprise a distal end having a second diameter that can be equal to or less than the first diameter of the central hole of the latching collar. The method can comprise moving the plunger through the first platen so that the distal end of the plunger can be inserted into the central hole of the latching collar.

In some embodiments, the method can comprise providing alignment indicia on the lower platen. The housing of the plunger unit can further comprise a laser source, and the laser source and the alignment indicia can be used to align the latching collar and the distal end of the plunger.

In some embodiments, the securing device can be adapted trigger power to the laser source. The securing device can comprise a center retainer cap incorporated in the receiving section of the housing. The cap can be affixed or otherwise connected with the securing device, or the cap can be separate from the securing device. The center retainer cap can be biased by a spring or a plurality of springs. The springs can be disposed below the center retainer cap, and can exert an upward force on the center retainer cap. Also disposed below the center retainer cap can be the switch that can trigger power to the laser source. As the securing device is tightened, the handle end of the securing device can push down on the center retainer cap forcing the center retainer cap downward and causing the springs to be retracted. The center retainer cap can be force downward and can contact the switch. When contacted by the center retainer cap the switch can be configured to trigger power to the laser source. The switch can be configured to supply power to the laser source until the center retainer cap is no longer in contact with the switch. As the securing device is loosened, the springs can force the center retainer cap up so that it is no longer in contact with the switch.

The power source can comprise an appropriate battery, for example, an alkaline battery, a nickel-metal halide battery, a lithium battery, or the like.

Reference will now be made to the drawings. According to various embodiments, and as shown in the FIGS., a plunger unit 10 can comprise a housing 15, a securing device 20, and a plunger 25. Housing 15 can be configured to receive securing device 20 and plunger 25. Plunger 25 can comprise a shaft 30 and a handle 35 comprising a top surface 40. Top surface 40 can be of any shape and size, for example, a curved, flat, or block shape. Plunger 25 further comprises a distal end 50, and a locking device 55, for example, a spring loaded, captured ball bearing. Securing device 20 can comprise a handle end 45, a threaded portion 46, and a distal end 60. Handle end 45 can be of larger diameter than threaded portion 46. Distal end 60 can be threaded, for example, as with a screw, bolt, or other threaded feature. Housing 15 can comprise a laser source 65. Housing 15 can further comprise a power supply 66 connected to laser source 65. Power supply 66 can be disposed anywhere within or attached to housing 15. Housing 15 can further comprise a switch 67 that can be in communication with both securing device 20 and power supply 66. Securing device 20 can be adapted to communicate with switch 67. Switch 67 can activate power supply 66 causing laser source 65 to emit a laser beam. In some embodiments, securing device 20 can also communicate with switch 67 to cause switch 67 to trigger power supply 66 off. This can cause laser source 65 to turn off. Power supply 66 can be removable, for example, a removable battery. Housing 15 can be configured such that laser source 65 can be removed from housing 15, and power supply 66 can be removed or replaced. This feature allows for the battery or other power supply to be replaced.

Figure 4A:
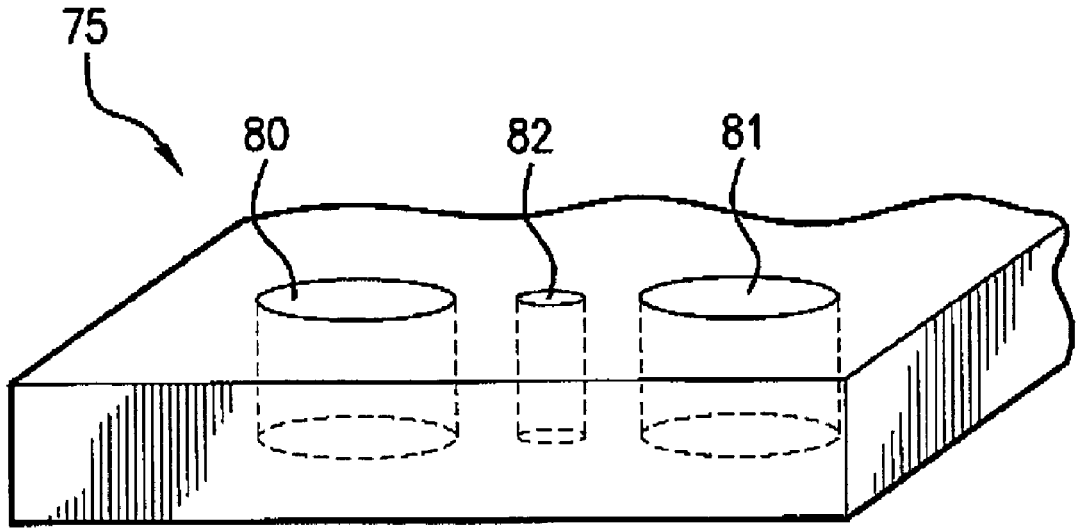
FIG. 4A is a perspective view of an upper platen comprising a hole for the laser source, a hole for the plunger, and a receiving area for the securing device, according to various embodiments of the present teachings.

According to various embodiments, plunger unit 10 can comprise a first alignment knob 70 and a second alignment knob 71. The knobs can be configured to help secure the plunger unit to holes in an upper platen 75, as can be seen in FIG. 4A. Upper platen 75 can comprise a first hole 80 for receiving first alignment knob 70, and a second hole 81 for receiving second alignment knob 71. Upper platen 75 can comprise a receiving area 82, for receiving securing device 20. Receiving area 82 can be threaded and can receive a threaded feature, for example, a screw, bolt, or other threaded feature of the securing device. As shown by the broken lines in FIG. 4A, first hole 80, second hole 81, and receiving area 82 can extend all the way through upper platen 75.

According to various embodiments, housing 15 can also comprise a biasing device 85, for example, a spring or other biasing device. Biasing device 85 can be configured for normally biasing plunger 25 in a normal position with respect to housing 15 yet permitting plunger 25 to be pushed partially through the housing to attain an extended position. Plunger 25 can have two corresponding states as well. When plunger 25 is in a normally biased state, biasing device 85 can be in a relaxed state. When plunger 25 is extended through the housing and through a platen, plunger 25 can be in an extended state. When plunger 25 extends down through housing 15, biasing device 85 can be connected to plunger 25, such that when plunger 25 extends, biasing device 85 retracts, causing biasing device 85 to be in a retracted state.

Attached or otherwise incorporated into the plunger can be a pin retainer cap 108. Pin retainer cap 108 can comprise wood or metal, for example, brass, aluminum, copper, steel, other type of metal, or a combination thereof. Pin retainer cap can be disposed such that when plunger 25 is driven downward, pin retainer cap 108 can exert force on biasing device 85, causing biasing device 85 to recoil or retract. When the force is removed, biasing device 85 can exert force on pin retainer cap 108, causing plunger 25 to extend back to its normally biased position.

Figure 1B:
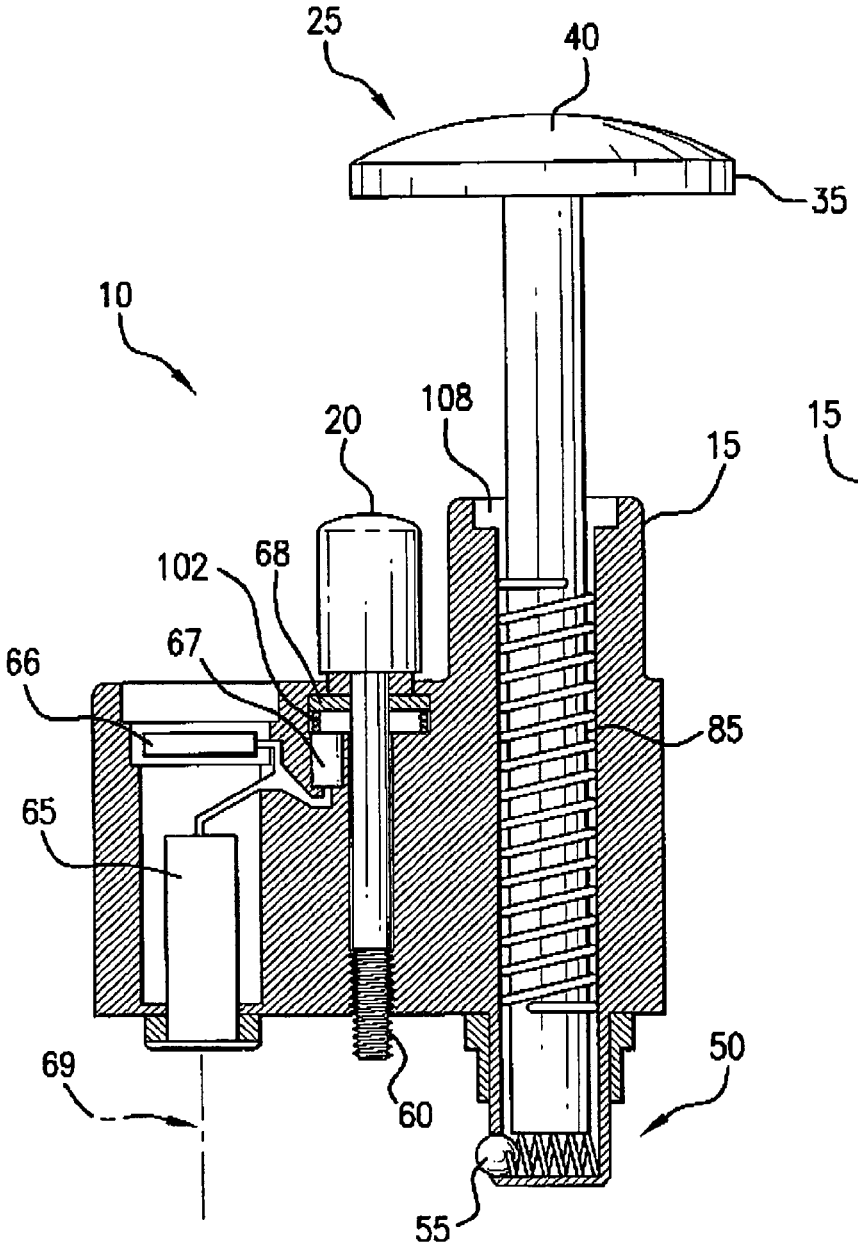
FIG. 1B is an internal perspective view of a plunger unit comprising a housing with front removed, a laser source, a securing device, a plunger, and a biasing device, according to various embodiments of the present teachings.
Figure 1C:
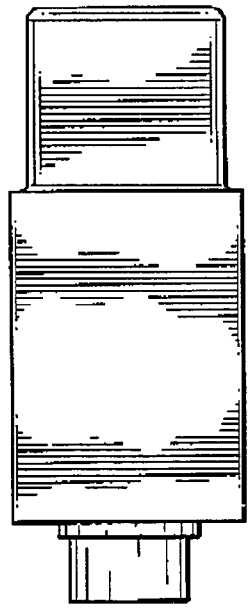
FIG. 1C is a side view of the housing shown in FIG. 1B.

According to various embodiments, shown in FIG. 1B is an interior view of plunger unit 10. As can be seen in FIG. 1B, laser source 65 can be disposed in housing 15. Connected to laser source 65 can be power supply 66. The power supply can be configured to receive a signal, trigger, or other form of notification from switch 67. A center retainer cap 68 can be disposed below securing device 20. Switch 67 can be disposed below center retainer cap 68. As will be appreciated, securing device 20 can be configured such that when securing device 20 is fastened, screwed, or otherwise turned to secure plunger unit 10 to a platen. Securing device 20 can exert a downward force upon center retainer cap 68. Beneath center retainer cap 68 can be a spring or group of springs that prevent center retainer cap from resting on switch 67. After enough turns of securing device 20, center retainer cap 68 can contact or otherwise trigger switch 67. Switch 67 can then trigger power supply 66 to supply power to laser source 65, thus turning a laser beam 69 on. When securing device 20 is unscrewed, or otherwise loosened, center retainer cap 68 can be forced up by the springs disposed beneath center retainer cap 68. Such force can cause center retainer cap to no longer contact switch 67, thereby causing switch 67 to trigger power supply 66 to stop emitting power to laser source 65, thereby turning laser beam 69 off. Shown in FIG. 1C is a side view of housing 15.

Figure 2:
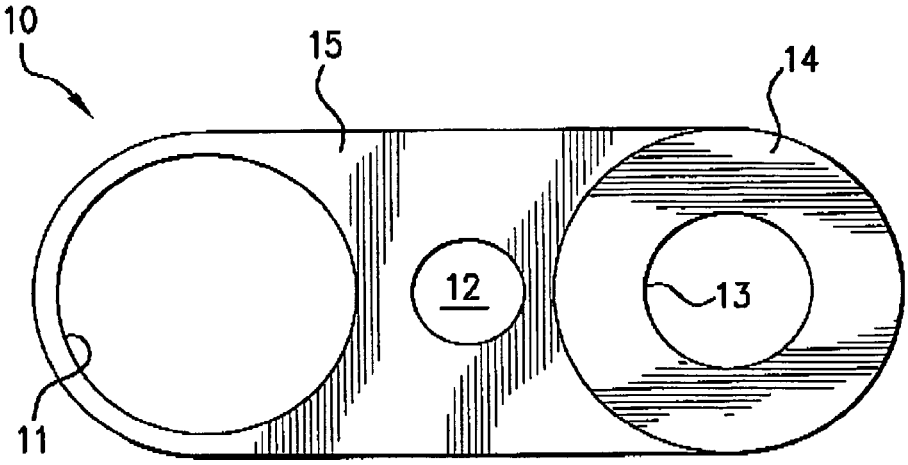
FIG. 2 is a top perspective view of a plunger unit with the laser source, securing device, and plunger removed, according to various embodiments of the present teachings.

According to various embodiments, FIG. 2 features a top view of plunger unit 10, with securing device 20 and plunger 25 removed. Housing 15 can comprise a laser source hole 11, which can be configured to hold laser source 65. Laser source hole 11 can also be configured to hold a laser module comprising laser source 65, power supply 66, and/or switch 67. Housing 15 can comprise a securing device hole 12, which can be configured to hold securing device 20, such that securing device 20 can be removably attached. Securing device hole 12 can be threaded and can allow securing device 20 to move, for example, such as a screw or other threaded feature which can be screwed and unscrewed for movement in the securing device hole 12. Securing hole 12 can be unthreaded but can accommodate a threaded shaft that is part of securing device 20.

In some embodiments, housing 15 can comprise a plunger hole 13 for holding plunger 25. Plunger hole 13 can be configured such that plunger 25 can have reciprocal motion through housing 15. Plunger hole 13 can be configured such that plunger 25 can have a normally biased state, and an extended state. Incorporated or otherwise constructed in housing 15 can be a raised plunger support 14. Raised plunger support 14 can prevent plunger 25 from being over extended when plunger 25 is extended into the central hole of the latching collar.

Figure 3B:
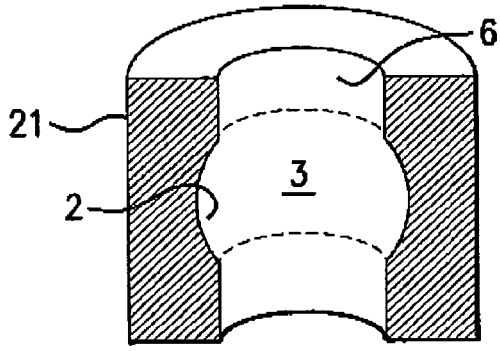
FIG. 3B is an internal perspective view of a latching collar including a groove, according to various embodiments of the present teachings.
Figure 3A:
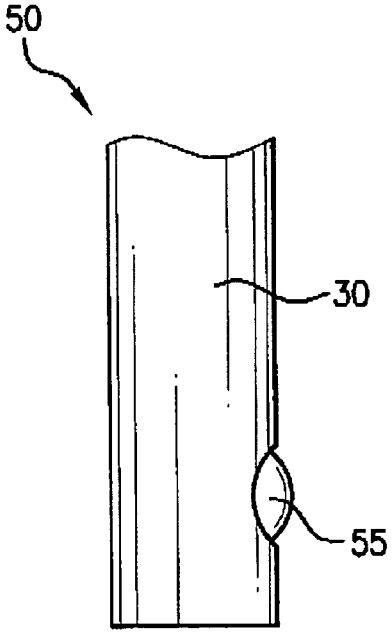
FIG. 3A is a perspective view of a distal end of a plunger comprising a locking device, according to various embodiments of the present teachings.
Figure 3C:
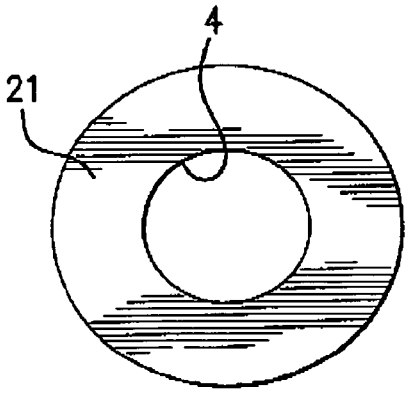
FIG. 3C is a top view of the latching collar shown in FIG. 3B.

According to various embodiments, Alignment device 10 can further comprise a latching collar. FIG. 3B shows a cutaway view of latching collar 21 cut in half. FIG. 3C shows a top view of latching collar 21. Latching collar 21 can comprise a groove 2. Groove 2 can be indented or recessed such that a locking area 3 can be formed in latching collar 21. Latching collar 21 can comprise a central hole 4, having a diameter large enough for allowing insertion of distal end 50 of plunger 25. FIG. 3A shows a perspective view of distal end 50 of plunger 25. As can be seen, locking device 55 can comprise a spring loaded ball bearing. When distal end 50 of plunger 25 is inserted into latching collar 21, the ball bearing can contact the upper wall 6 of latching collar 21, causing the spring loaded ball bearing to recoil or retract. As distal end 50 continues to be pushed further down into latching collar 21, the ball bearing will stay retracted until it reaches locking area 3 of latching collar 21, at which time the spring loaded ball bearing will extend into a normal extended, but captured, position. Once extended, locking area 3 can be configured to lock distal end of plunger 25 in latching collar 21.

Referring back to FIGS. 1A-1B, distal end 50 of plunger 25 is locked into latching collar 21, plunger 25 can be in an extended position, and biasing device 85 can be in a retracted position. If distal end 50 of plunger 25 is moved upward out of latching collar 21, biasing device 85 can be configured to return plunger 25 back to its normally biased state.

Figure 4B:
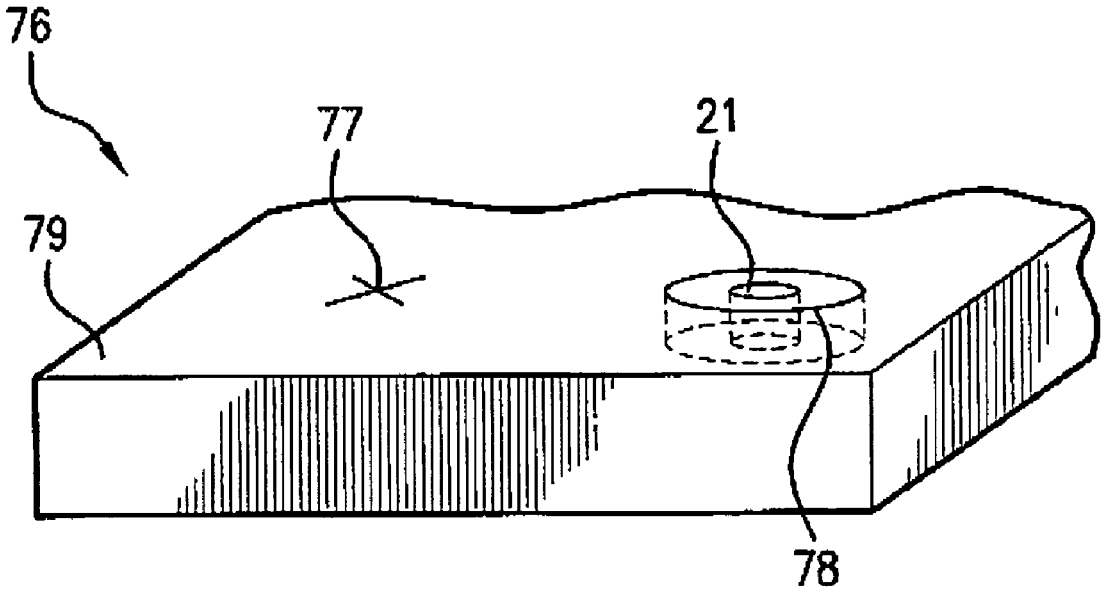
FIG. 4B is a perspective view of a lower platen comprising alignment indicia and a latching collar affixed thereto, according to various embodiments of the present teachings.

In various embodiments, as can be seen in FIG. 4B, lower platen 76 can comprise alignment indicia 77 and latching collar receiving section 78. Latching collar 21 has been inserted into latching collar receiving section 78. Alignment indicia 77 can comprise cross-hairs, a symbol, an engraving, an alphanumeric character, a plurality of alphanumeric characters, or any other design or engraving desired. When alignment device 10 comprises laser source 65, laser source 65 and alignment indicia 77 can be used to align plunger 25 and latching collar 21. As shown by the broken lines in FIG. 4B, latching collar receiving section 78 can be designed to extend into lower platen 76. Latching collar receiving section 78 can extend partially into lower platen 76, or it can extend all the way through lower platen 76. It will be appreciated that latching collar receiving section 78 does not have to extend into lower platen 76. In such an arrangement, latching collar 21 can be affixed to a top surface 79 of lower platen 76.

Figure 5A:
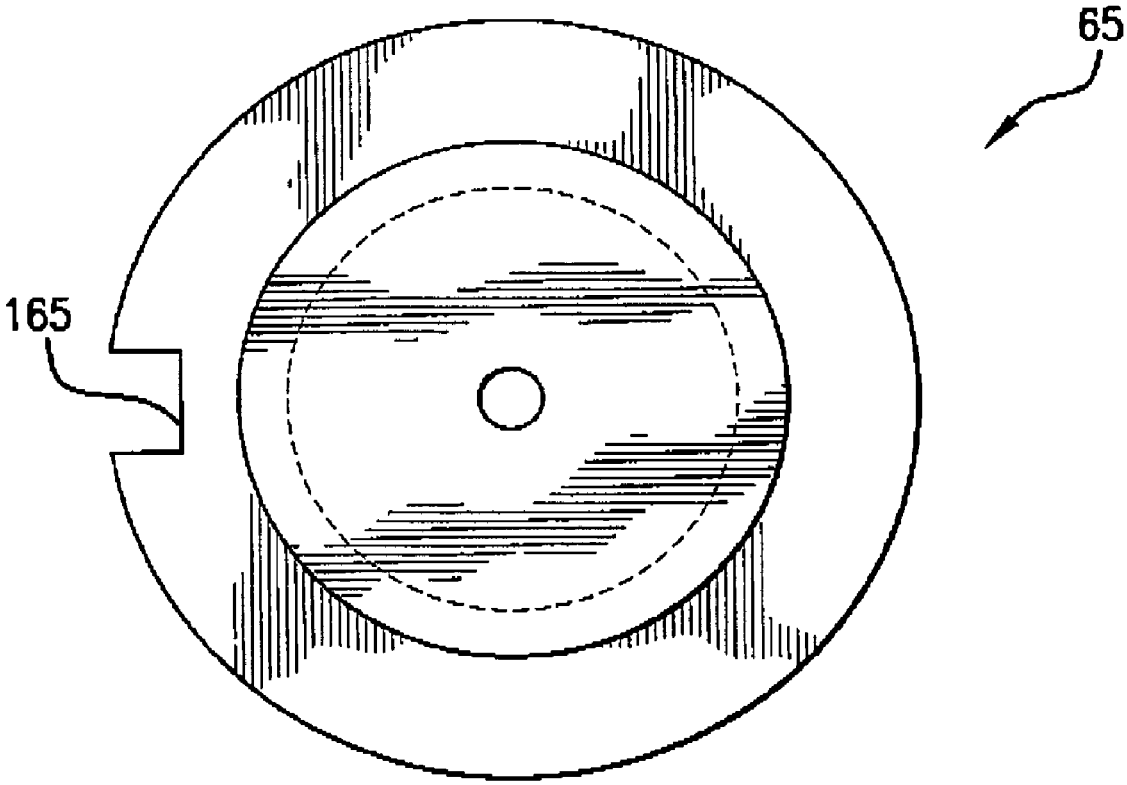
FIG. 5A is a bottom view of a laser source comprising a groove, according to various embodiments of the present teachings.
Figure 5B:
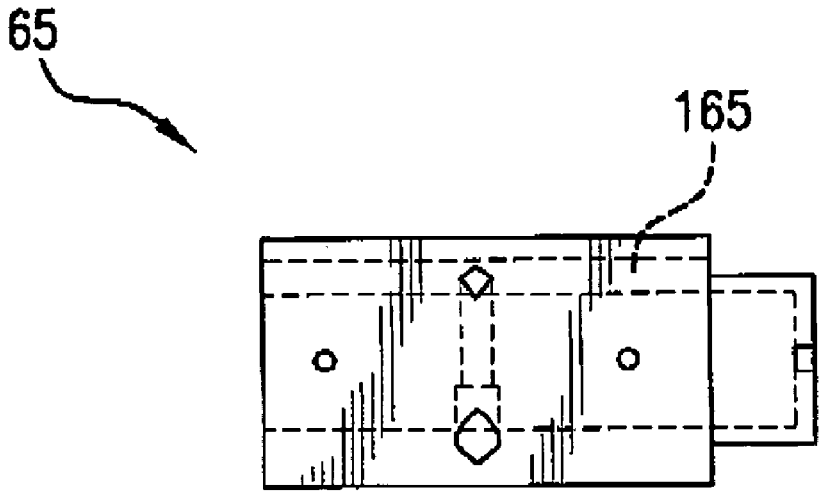
FIG. 5B is a side view of the laser source shown in FIG. 5A.
Figure 5C:
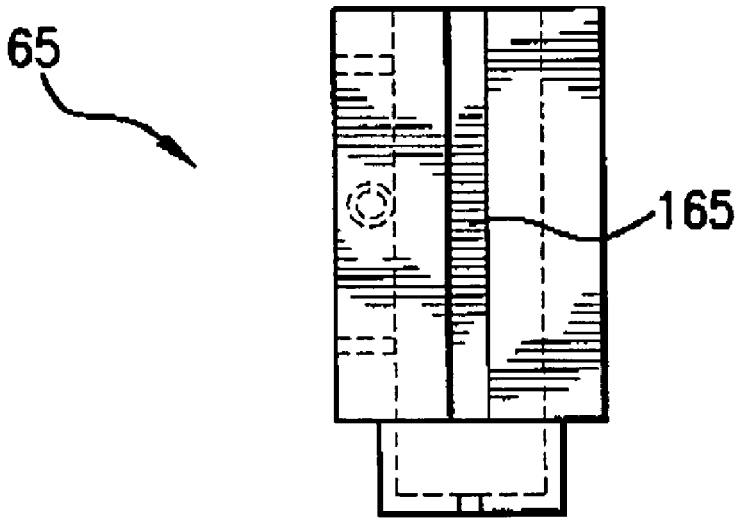
FIG. 5C is another side view of the laser source shown in FIG. 5A.

According to various embodiments, a more detailed view of laser source 65 can be seen in FIGS. 5A-5C. FIG. 5A shows a emission side perspective of laser source 65. As can be seen, laser source 65 can be configured with a groove 165. Housing 15 can also be configured with a similar protrusion or latch that corresponds to groove 165. This can allow the laser source to be removably secured in housing 15. FIGS. 5B and 5C show two side views of laser source 65 including groove 165.

Figure 6A:
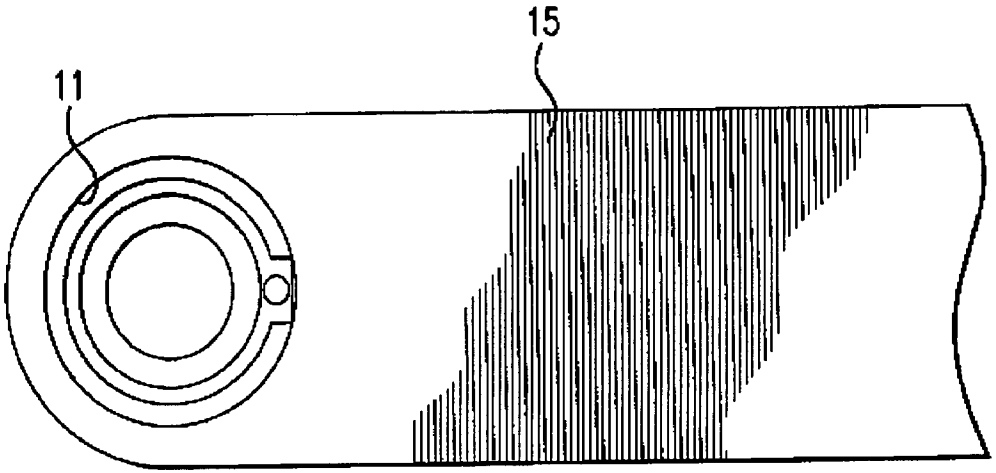
FIGS. 6A and 6B are a top view and a side view, respectively, of a housing, the housing comprising features for holding the laser source, according to various embodiments of the present teachings.
Figure 6B:
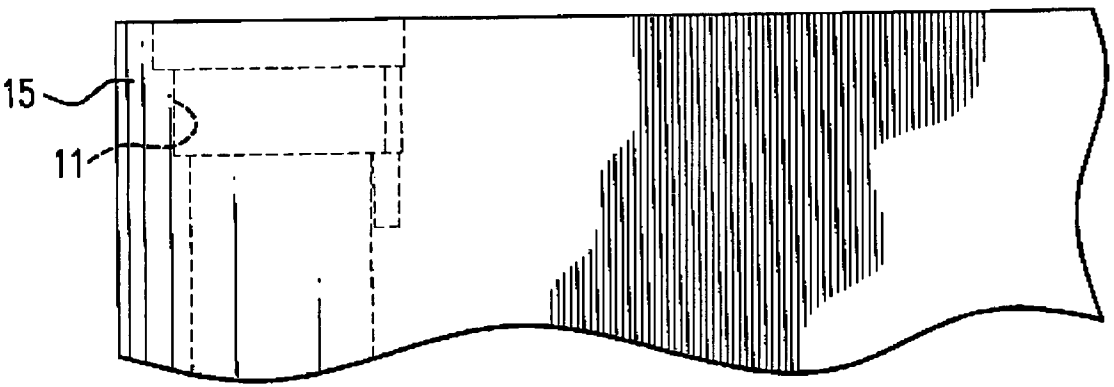

According to various embodiments, housing 15 can be configured to hold in place, laser source 65, as shown in FIGS. 6A and 6B. The top view of FIG. 6A shows a portion of housing 15, including the laser source hole 11. The laser source has been removed leaving a view of the empty laser source hole 11. The side view of FIG. 6B shows housing 15 with laser source hole 11. The broken lines indicate where the laser source hole can be located.

Figure 7A:
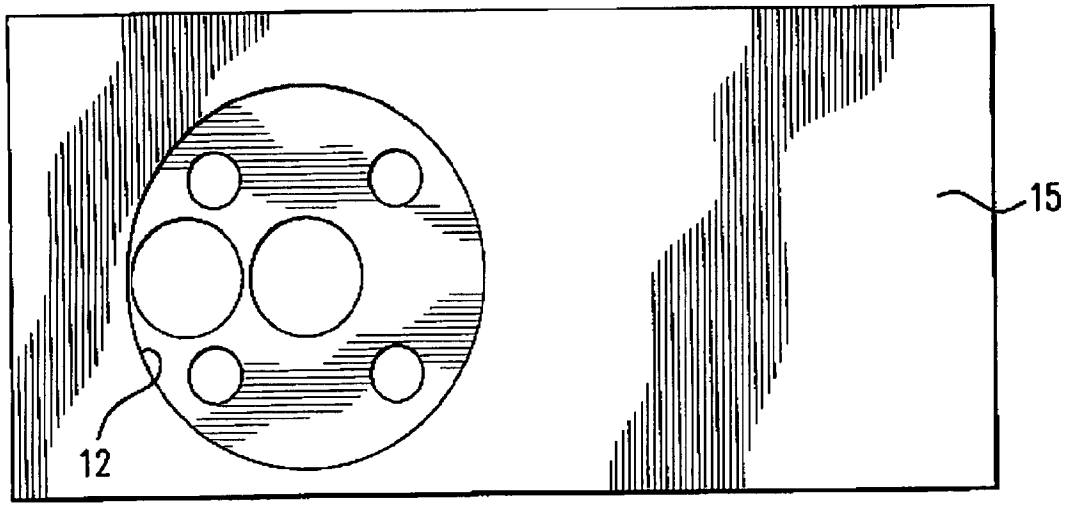
FIGS. 7A and 7B are a top view and a side view, respectively, of a housing, the housing comprising features for holding s securing device, a trigger, and a center retainer cap including a central hole, according to various embodiments of the present teachings.
Figure 7B:
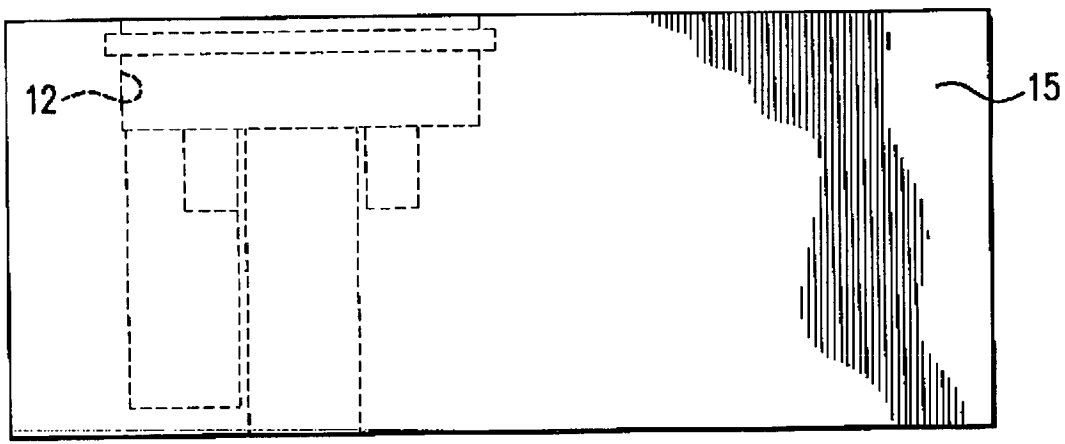

According to various embodiments, housing 15 can be configured to receive securing device 20, and can be configured to allow for securing device 20 to contact switch 67, as shown in FIGS. 7A and 7B. The securing device has been removed from FIGS. 7A and 7B leaving securing device hole 12 empty. The top view in FIG. 7A is a top view of the housing with the securing device removed. As shown in FIGS. 8A-8D, a center retainer cap 104, can be inserted into securing device hole 12, and can comprise any kind of suitable material, for example, copper, brass, aluminum, steel, wood, or other material. Center retainer cap 104 can be disposed above one or more springs 102 that can also be incorporated into securing device hole 12. In some embodiments, four springs 102 are used, but it will be appreciated that more or less than four can be used. Center retainer cap 104 can comprise a central hole 114, having a diameter less than the diameter of securing device 20.

According to various embodiments, the alignment device can be configured such that when securing device 20 is inserted into housing 15, and a user begins to tighten securing device 20, handle end 45 of securing device 20 can exert a downward force on center retainer cap 104. The more that securing device 20 is tightened the further down center retainer cap 104 can be driven. Switch 67 can be located in the housing, below center retainer cap 104, such that when center retainer cap 104 is driven downward it can come into contact with switch 67. When this contact occurs, switch 67 can trigger power supply 66 to supply power to laser source 65. In various embodiments, when securing device 20 is loosened, springs 102 can exert an upward force on center retainer cap 104 causing center retainer cap to extend back to an original state. This upward force can drive center retainer cap 104 so that it no longer contacts switch 67. When no longer contacted by center retainer cap 104, switch 67 can trigger power supply 66 to relinquish power to laser source 65. At the bottom of FIG. 7 can be seen the housing with securing device hole 12 that can be configured to hold center retainer cap 104, springs 102, securing device 20, and switch 67.

Figure 8A:
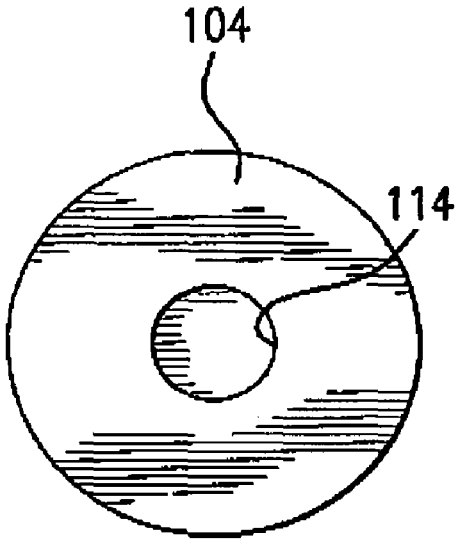
FIGS. 8A and 8B are a top view and a side view, respectively, of a center retainer cap comprising a central hole, according to various embodiments of the present teachings.
Figure 8B:
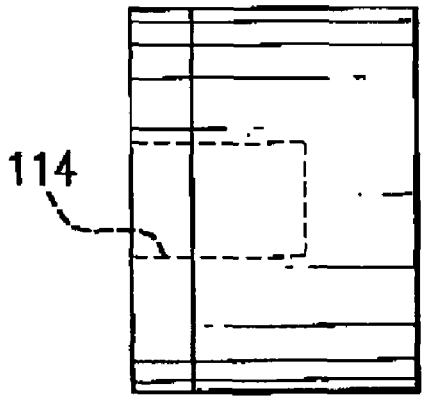
Figure 8C:
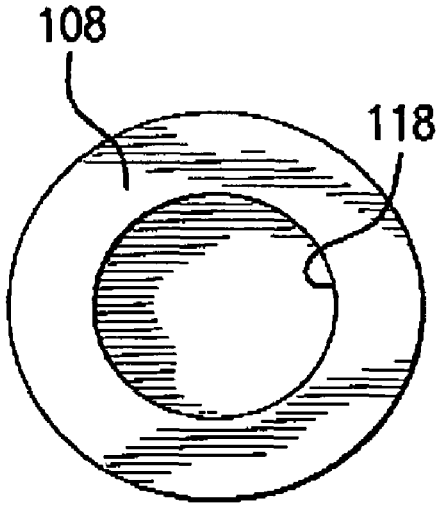
FIGS. 8C and 8D are a top view and a side view, respectively, of a pin retainer cap comprising a central hole, according to various embodiments of the present teachings.
Figure 8D:
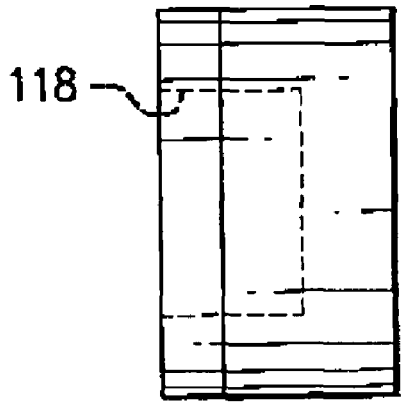

According to various embodiments, center retainer cap 104 can comprise a circular shape as seen in FIG. 8A and 8B center retainer cap 104 can comprise a central hole 114. Central hole 114 can be of a diameter so as to allow threaded portion 46 of securing device 20 to extend through central hole 114. Central hold 114 can be of a diameter such that handle end 45 of securing device 20 is not able to pass through. This can allow handle end 45 to exert force on center retainer cap 104. Pin retainer cap 108 can comprise similar features as center retainer cap 104, as shown in FIGS. 8C and 8D. Pin retainer cap 108 can comprise a central hole 118 that has a diameter large enough to allow shaft 30 and distal end 55 of plunger 25 to pass through. Central hole 118 can have a diameter that does not allow handle 35 of plunger 25 to pass through. Pin retainer cap can be incorporated into, affixed to, or otherwise secured to plunger 25. This can allow pin retainer cap 108 to exert force on biasing device 85, when plunger 25 is pushed down.

Figure 9B:
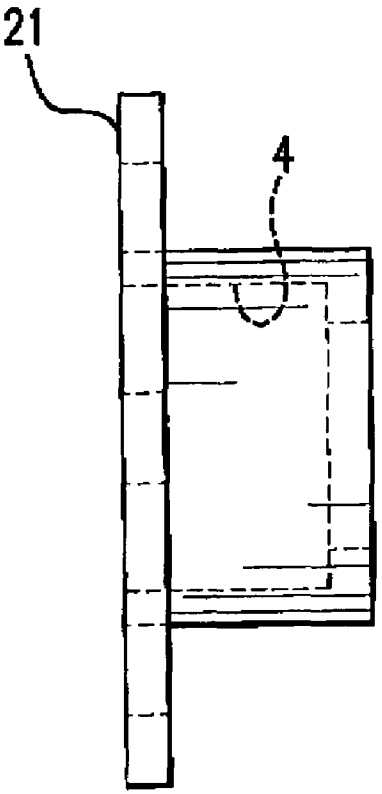
FIGS. 9A and 9B are a top view and a side view, respectively, of a latching collar comprising a central hole, according to various embodiments of the present teachings.
Figure 9A:
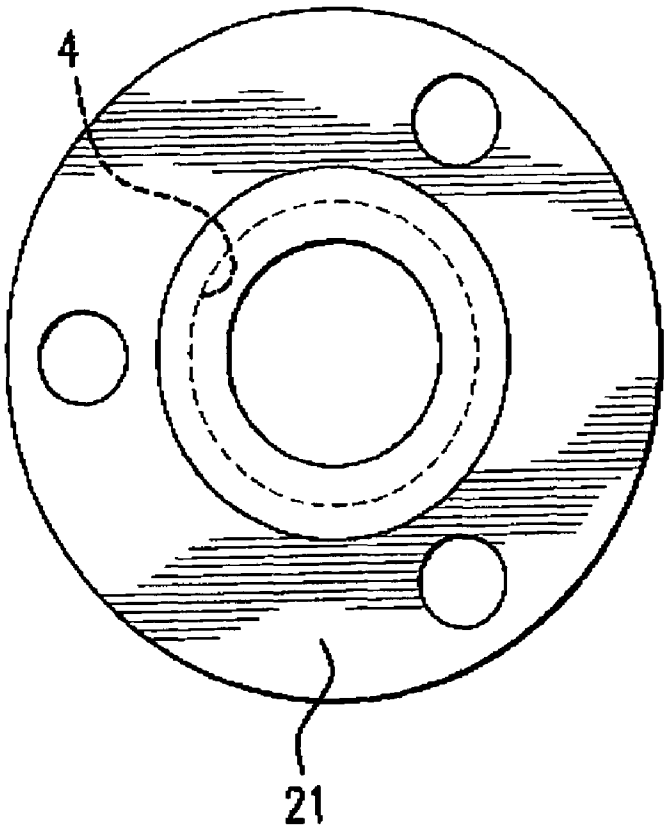

According to various embodiments, a more detailed view of latching collar 21 can be as seen in FIGS. 9A and 9B. FIG. 9A shows a top view of latching collar 21 and FIG. 9B shows a side view of latching collar 21. The broken lines indicate central hole 4 of latching collar 21.

According to various embodiments, the upper platen and lower platen can be manufactured with similar or equivalent holes and indicia. This can allow for mass production of paperboard press platens that can be configured to be used with the alignment device of the present teachings. This can allow the alignment device to be removed and used on multiple sets of platens. The alignment device can be configured to be interchangeable between different types of paperboard press platens, for example, a blanking press, a stripping press, an embossing press, a die-cutting press, another type of paperboard press, or a combination thereof.

Other embodiments will be apparent to those skilled in the art from consideration of the present specification and practice of various embodiments disclosed herein. It is intended that the present specification and examples be considered as exemplary only.

What is claimed is:

1. An alignment device for aligning an upper platen of a paperboard press with a lower platen of a paperboard press, the alignment device comprising:

a latching collar comprising a central hole and adapted to be mounted on the lower platen, the central hole having a first diameter;

a plunger unit comprising a housing;

a securing device being adapted to removably secure the housing to a top surface of the upper platen, and a plunger being configured for reciprocal motion through the housing and being adapted to extend through the upper platen, the plunger comprising a distal end having a second diameter that is less than or equal to the first diameter; and a biasing device for normally biasing the plunger in a relaxed position with respect to the housing yet permitting the plunger to be pushed partially through the housing to attain an extended position.

2. The alignment device of claim 1, wherein the paperboard press comprises a blanking press.

3. The alignment device of claim 1, wherein the paperboard press comprises a stripping press.

4. The alignment device of claim 1, wherein the paperboard press comprises a die-cutting press.

5. The alignment device of claim 1, wherein the paperboard press comprises an embossing press.

6. The alignment device of claim 1, wherein the plunger unit further comprises:

a laser source in the housing, and a power supply in the housing, connected to the laser source, wherein the laser source is adapted to emit at least one excitation beam through a hole in the upper platen and onto a top surface of the lower platen.

7. The alignment device of claim 6, wherein the securing device is further adapted to trigger the power supply connected to the laser source.

8. The alignment device of claim 1, further comprising a locking device on the distal end of the plunger, configured to lock the plunger into the latching collar.

9. A system comprising the alignment device of claim 1, an upper platen of a paperboard press, and a lower platen of a paperboard press, wherein the housing is secured to a top surface of the upper platen, and the latching collar is fixed to the lower platen.

10. The system of claim 9, wherein the lower platen and the upper platen are aligned such that the plunger is in the extended position and extends through the upper platen, and the distal end of the plunger is received in the latching collar.

11. The system of claim 9, wherein the lower platen further comprises one or more alignment indicia.

12. The system of claim 9, wherein the plunger unit further comprises a laser source configured to provide a laser beam directed out of a bottom of the housing.

13. The system of claim 12, wherein the upper platen comprises a hole aligned with the laser beam and is disposed to allow the laser beam to pass through the upper platen.

14. The system of claim 13, wherein the system is configured to align the plunger and the latching collar using the laser beam and the one or more alignment indicia.

15. A method for aligning an upper platen of a paperboard press with a lower platen of a paperboard press, the method comprising:

fixing a latching collar to the lower platen, the latching collar comprising a central hole having a first diameter;

securing a plunger unit to the upper platen, the plunger unit comprising a housing, a securing device to removably secure the plunger unit to the upper platen, and a plunger configured for reciprocal motion through the housing and being adapted to extend through the upper platen, the plunger comprising a distal end having a second diameter that is less than or equal to the first diameter; and moving the plunger through the first platen so that the distal end of the plunger is inserted into the central hole of the latching collar.

16. The method of claim 15, wherein the paperboard press comprises at least one of a stripping press, a blanking press, an embossing press, and a die-cutting press.

17. The method of claim 15, further comprising providing alignment indicia on the top surface of the lower platen, and a hole in the upper platen.

18. The method of claim 17, wherein the housing further comprises a laser source adapted to emit a laser beam through the hole in the upper platen, and the method further comprises aligning the plunger and the latching collar using the laser source and the alignment indicia.

19. The method of claim 18, wherein the securing a plunger unit to the upper platen further comprises triggering power to the laser source.

* * * * *